US008157537B2

(12) United States Patent
Chavez Zapata

(10) Patent No.: US 8,157,537 B2
(45) Date of Patent: Apr. 17, 2012

(54) METHOD, SYSTEM, AND APPARATUS FOR OPERATING A SUCKER ROD PUMP

(75) Inventor: Cesar Antonio Chavez Zapata, Chihuahua (MX)

(73) Assignee: Petrolog Automation, Inc, Odessa, TX (US)

( * ) Notice: Subject to any disclaimer, the term of this patent is extended or adjusted under 35 U.S.C. 154(b) by 966 days.

(21) Appl. No.: 12/138,517

(22) Filed: Jun. 13, 2008

(65) Prior Publication Data

US 2009/0311107 A1 Dec. 17, 2009

(51) Int. Cl.
*F04B 49/06* (2006.01)
*F04B 43/12* (2006.01)

(52) U.S. Cl. ..... 417/53; 417/555.2; 417/12; 417/63; 73/1.15; 73/1.79

(58) Field of Classification Search ..... 417/555.2, 417/12, 53, 63; 73/1.08, 1.15, 1.75, 1.79; 166/64

See application file for complete search history.

(56) References Cited

U.S. PATENT DOCUMENTS

| | | | | | |
|---|---|---|---|---|---|
| 4,407,155 | A * | 10/1983 | Sundeen | 73/114.63 |
| 4,433,572 | A * | 2/1984 | Sundeen | 73/114.63 |
| 4,587,839 | A * | 5/1986 | Doniwa | 73/114.28 |
| 4,589,278 | A * | 5/1986 | Ginns | 73/114.28 |
| 4,594,665 | A * | 6/1986 | Chandra et al. | 702/6 |
| 5,167,490 | A * | 12/1992 | McKee et al. | 417/12 |
| 5,589,633 | A * | 12/1996 | McCoy et al. | 417/63 |
| 6,874,473 | B2 * | 4/2005 | Carpenter | 123/406.18 |
| 2004/0062657 | A1 * | 4/2004 | Beck et al. | 417/42 |

* cited by examiner

*Primary Examiner* — Devon C Kramer
*Assistant Examiner* — Thomas Fink
(74) *Attorney, Agent, or Firm* — Defillo & Associates, Inc; Evelyn A. Defilló

(57) ABSTRACT

Apparatus, methods, and system for wireless remote monitoring and controlling a sucker rod pump for producing hydrocarbons, providing self-adjusting methods for operation over a wide-range of operating conditions according to algorithms that automatically compensate for offset and amplitude drift in sensor data, automatically identify pump off conditions, and automatically optimize hold down time.

6 Claims, 7 Drawing Sheets

METHOD, SYSTEM, AND APPARATUS FOR OPERATING A SUCKER ROD PUMP

FIELD OF THE INVENTION

The present invention relates to an apparatus, system and method for the monitoring and control of sucker rod pumps for the production of hydrocarbons. More particularly, the present invention relates to an apparatus, system and method for monitoring and analyzing pump conditions in real time, for controlling operation of the pump, and for remote monitoring and control.

BACKGROUND OF THE INVENTION

Hydrocarbons are often produced from well bores by sucker rod pumps, which are reciprocating pumps driven from the surface by drive units that move a polished rod up and down through a packing gland at a wellhead. Typically, a walking beam is pivotally mounted with one end of the beam being attached to the rod and with the beam being reciprocated by a drive unit. The drive unit consists of a prime mover connected to a reduction unit that drives a crank to reciprocate the walking beam.

While sucker rod pumps are relatively simple units, they are expensive to provide and maintain. Repair may require lifting of the entire down-hole unit to the surface. It is not unusual to have a mile or more of sucker rods or tubing that must be lifted and disassembled by one or two twenty five or thirty foot long sections at a time. This repair is costly in terms of repair labor and parts cost, and in the terms of lost revenue from the well.

Power requirements of the sucker rod pump are also significant, and are affected by the efficiency at which the unit is operating.

Sucker rod pumping units are typically designed to pump slightly more than the well can produce. Consequently, they eventually run out of liquids to pump, and draw gas into the cylinders, a condition known as a pump off condition.

In a pump off condition, the fluid level in the well is not sufficient to completely fill the pump barrel on the upstroke. On the next downstroke the plunger will impact the fluid in the incompletely filled barrel and send damaging shock waves through the components of the pumping system.

To minimize running pumped off, sucker rod pumps are generally operated with some type of controller. These controllers are either simple controllers designed not to detect a pump off condition, but rather to avoid an estimated pump off condition, or are more sophisticated pump off controllers designed to detect when a well pumps off and to shut the well down.

An example of these simple controllers are clock timers that start and stop the pumping unit in response to a set program designed to avoid a pump off condition. Unfortunately, these simple clock timers are not responsive to changing conditions, such as changes in the reservoir, or the occurrence of abnormal operating conditions. Such a changing condition may occur, with the timer continuing its on/off cycle until human intervention. Numerous methods have therefore been proposed to monitor and control sucker rod pump operation.

Common commercially available controllers monitor work performed, or something that relates to work performed, as a function of polished rod position. This information is generally presented in the form of a plot of load vs. rod string displacement on the rod string. For a normally operating pump, the shape of this plot (known as a "surface card"), is generally an irregular football shape. The area inside of this rectangle is proportional to the work being performed. Many pump off controllers utilize a plot such as this to determine when the sucker rod pump is pumped off, and then shutdown the pump for a time period when a criteria indicating the pump is not filling.

Other pump off controllers attempt to obtain load measurements that more accurately reflect the load on the sucker rod underground. For example, U.S. Pat. No. 3,306,210 discloses a pump off controller that monitors the load on the polished rod at a set position in the downstroke. Pump off is detected when the load exceeds a preset level at that set position. A disadvantage of this approach is that long cables are required from the sensor on the polished rod to the controller. These cables hang around interfering with the most frequent maintenance activities in the well, being continually damaged by service crews. Additionally since they are subject to the repetitious motion of the well are prone to failure. Also, a separate position sensor is typically used on the walking beam, further complicating design.

In use, monitoring and recalibration of pump off controllers may be required on a regular basis to ensure that wear, drift, loss of sensitivity, temperature effects, and a myriad of other conditions do not render the detection of pump off conditions ineffective over time. Monitoring and servicing wells is expensive and time-consuming and requires the operator to physically stand by the pump off controller to gather and analyze operating data provided by conventional numerical or graphic displays, which is time-consuming and inefficient.

For at least the foregoing reasons, there remains a need for an apparatus that is easily installed and operated with the minimum of calibration or operator intervention, for a method that can automatically identify and implement the optimum time out for the well, and provides features for remote data collection and remote operation.

SUMMARY OF THE INVENTION

The present invention is directed to a method, apparatus, and system that satisfies the aforementioned needs and more.

According to one embodiment of the present invention, there is a provided a method for compensating for offset and amplitude drift in position and load sensor data from a sucker rod pump. The method includes gathering position sensor data during operation of a pump, and calculating a position horizon value from the midpoint of consecutive minimum and maximum position values. By measuring the time interval between a positive horizon crossing and a negative horizon crossing, the peak time is calculated from the midpoint of the time interval. By continuously updating the horizon and peak time values, and by repeating the above steps for every pump cycle, compensation for offset and amplitude drift in the position sensor data is achieved. For the load sensor, the method includes gathering the load sensor data during operation of the pump and for each pump cycle, record the minimum load, maximum load, start-up load and start-down load. Recalculating the new reference load boundary value always from the previous cycle data allows compensation for offset and amplitude drift in the load sensor.

According to another embodiment of the present invention, there is a provided a method for identifying a pump off condition in a sucker rod pump. It is advantageous to stop a pump that is in pump off condition to avoid mechanical damage. The method includes gathering position sensor and/or load sensor data during operation of a pump, and, for each pump cycle, recording the minimum load, the maximum load, the start-up load, and the start-down load, by the method previously described. After identifying the start of the downstroke for a subsequent pump cycle, a reference load boundary is calculated by adding to the minimum load a predetermined fraction of the difference between the start-down load and the minimum load. This reference load boundary can be used to determine normal operation of the pump. The time for the load to decrease below the reference load boundary is measured, and a pump off condition is detected if the load has not decreased below the reference load boundary within a predetermined time.

According to another embodiment of the present invention, there is a provided a method for optimizing operation of a sucker rod pump. The method includes acquiring data for hold down time and pumping span by incrementally increasing the hold down time within predetermined limits and by predetermined step sizes for each subsequent pump off condition. By recording the pumping span following each hold down time, for example by recording the number of pump cycles before the next pump off condition, and then interpolating from this data a hold down time corresponding to a predetermined fraction of the maximum recorded pumping span, an optimum hold down time can be obtained for subsequent operation of the pump.

According to another embodiment of the present invention there is provided an apparatus for automating operation of a sucker rod pump. An apparatus having features of the present invention has a microcontroller module having, in electronic communication, a microcontroller, a non-volatile memory, one or more actuators for controlling the prime mover, and at least two ports for receiving sensor data. The apparatus further comprises a sensor module with a load sensor and a position sensor, and the sensor module is capable of mounting to the walking beam for example by attachment with a pair of C-clamps. The outputs of the load sensor and position sensor are connected to the ports of the microcontroller module and the non-volatile memory of the microcontroller module contains software for running by the microcontroller to process the sensor data and operate the actuators. The apparatus further comprises a wireless module for communication of data and instructions between the microcontroller module and a remote wireless device.

According to another embodiment of the present invention there is provided a system for self-adapting to amplitude and offset variability in load-position data of a sucker rod pump. A system having features of the present invention has an apparatus according the present invention in which the non-volatile memory contains software that, when executed, instructs the microcontroller to collect position sensor data during operation of the pump and to calculate a position horizon value from the midpoint of consecutive minimum and maximum position values. The program measures the time interval between a positive horizon crossing and a negative horizon crossing to calculate a peak time from the midpoint of the time interval. The program updates the horizon and peak time values by repeating steps the described process for every pump cycle. By this means, the system continuously self-adapts to offset and amplitude drift in the position sensor data. For the load sensor, the program instructs the microcontroller to collect load sensor data during operation of the pump and for each pump cycle, record the minimum load, maximum load, start-up load and start-down load. Recalculating the new reference load boundary value always from the previous cycle data allows compensation for offset and amplitude drift in the load sensor.

According to yet another embodiment of the present invention there is provided a system for detecting a pump off condition in a sucker rod pump. A system having features of the present invention has an apparatus according the present invention in which the non-volatile memory contains software that, when executed, instructs the microcontroller to collect position sensor and load sensor data during operation of the pump and, for each pump cycle, record the minimum load, maximum load, start-up load, and start-down load. The software likewise identifies the start of the downstroke for a subsequent pump cycle and calculates a reference load boundary by adding to the minimum load a predetermined fraction of the difference between the start-down load and the minimum load. The time for the load to decrease below the reference load boundary is measured to determine a pump off condition if the load has not decreased below the reference load boundary within a predetermined time.

According to yet another embodiment of the present invention there is provided a system for optimizing operation of a sucker rod pump. A system having features of the present invention has an apparatus according the present invention in which the non-volatile memory contains software that, when executed, instructs the microcontroller to detect a pump off condition and stop the pump for a certain hold down time. The hold down time is incrementally increased within preset limits and by preset step sizes for each subsequent pump off condition and the pumping span following each hold down time is recorded. The system processes the pumping span data to interpolate a hold down time corresponding to a preset fraction of the maximum recorded pumping span. The system then operates the pump using the interpolated hold down time.

It is therefore an object of the present invention to provide a method, apparatus, and system for monitoring and/or controlling a sucker rod pump, which do not suffer from the prior art drawbacks.

It is a further object of the present invention to provide for method, apparatus, and systems that can be easily installed and operated with the minimum of calibration and operator intervention.

It is yet a further object of the present invention to provide for method, apparatus, and systems that can automatically identify and implement the optimum time out for the well according to geological and electromechanical conditions for efficient operation of the pump.

It is yet a further object of the present invention to provide for method, apparatus, and systems for remote data collection from a well for the collection of historic and/or real time operational data from a well, and for the graphical display of the data such as a surface card, on a remote device such as a wireless-equipped handheld computer.

It is yet a further object of the present invention to provide for method, apparatus, and systems for remote operation of the well via a long-distance wireless communication linkage.

BRIEF DESCRIPTION OF THE DRAWINGS

These and other features, aspects, and advantages of the present invention will become better understood with regard to the following description, appended claims, and accompanying drawings where:

DETAILED DESCRIPTION

Certain exemplary but non-limiting embodiments of the present invention are now described with reference to the attached drawings.

Figure 1:
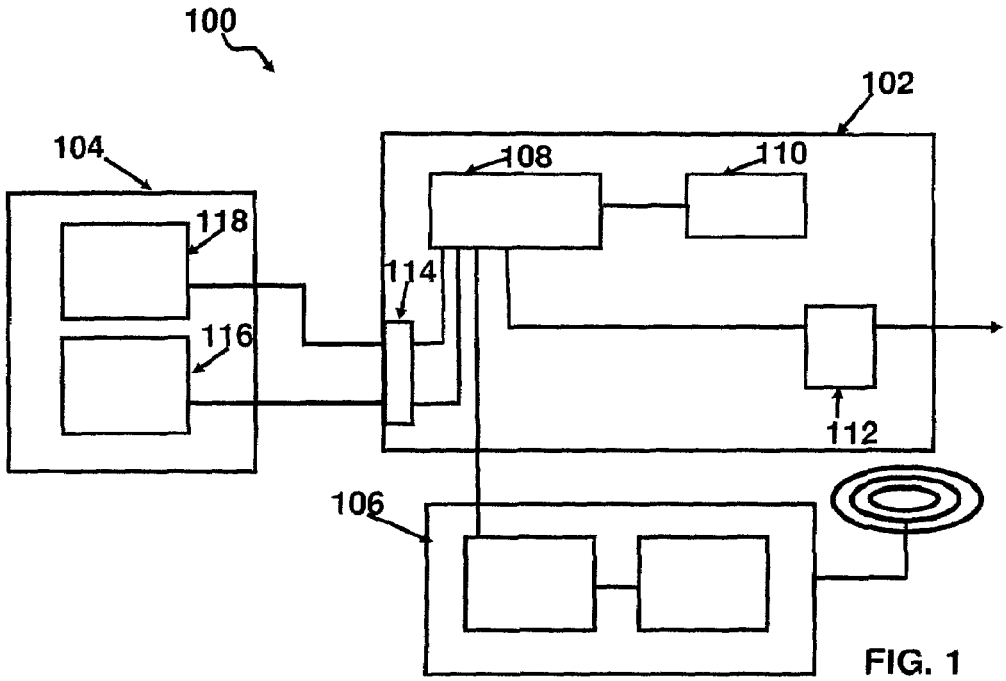
FIG. 1 is a schematic representation of one embodiment of an apparatus according to the present invention.

Referring now to FIG. 1, there is shown a schematic representation of an apparatus 100 according to the present invention, including microcontroller module 102, sensor module 104, and wireless module 106.

Microcontroller module 102 comprises a microcontroller 108 and non-volatile memory 110 in electronic communication. Microcontroller 108 is further in electronic communication with one or more actuators 112, such as for example high current relays, for controlling operation of the prime mover of the pump, and with a plurality of ports 114 for collecting sensor inputs and for communicating with wireless module 106. Preferably, microcontroller input and output ports are optically isolated.

As used herein, the term "microcontroller" refers without limitation to any microprocessor design that preferably emphasizes high integration, low power consumption, self-sufficiency and cost-effectiveness. Exemplary microcontrollers include Intel 8742, the SX line from Parallax, Inc., and the 8051 architecture from Atmel. It will be understood that the term encompasses the use of microprocessors such as are found within personal computers and the like within the scope of the apparatus and system of the present invention.

Non-volatile memory 110 can be, for example, flash RAM, a hard drive, EPROM, or any other memory device now known or later developed for the storage of programs or data that are not lost when the microcontroller module is powered down.

Sensor module 104 comprises position sensor 118 and load sensor 116 and associated electronics to amplify and condition the sensor signals. Sensor module 104 is mountable to the walking beam of the pump, preferably at a midpoint, to sense the inclination and load of the walking beam. Preferably, the sensor module 104 is mounted by bolts or a pair of C-clamps. The sensor module 104 is mounted to the walking beam in a manner that permits the load sensor to convert deformation of the walking beam into electrical signals proportional to the well load. Position sensor 118 is preferably an inclinometer that generates electrical signals proportional to the inclination of the walking beam, or can any other sensor capable of detecting the position of the walking beam throughout the pump cycle.

Wireless module 106 comprises electronics and antennae for long-range wireless communication, short-range wireless communication, or both. Examples of short range wireless protocols include Bluetooth and 802.11 series communication protocols. Examples of long-range wireless protocols include SCADA protocols. The wireless communication permits the downloading of historical and real-time data from the apparatus, and optionally control of the pump from the remote device. For example, a handheld computer can retrieve the operating record of the pump over an extended period of time, or can retrieve a real-time graphical display of the surface card.

It should be understood that, although microcontroller module 102, sensor module 104, and wireless module 106 are shown as separate boxes in FIG. 1, any two or all three can be combined into one physical unit. Likewise, the components of any one module can be separated into two or more physical units.

Figure 2:
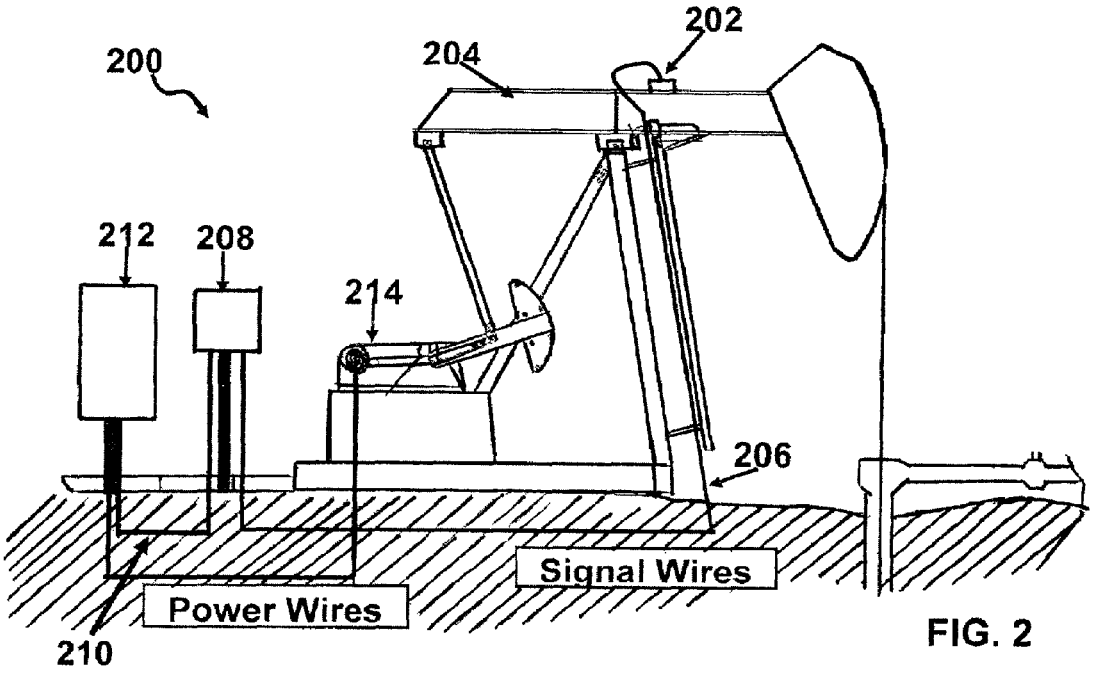
FIG. 2 is a schematic representation of one embodiment of an apparatus according to the present invention mounted to a sucker rod pump.

Referring now to FIG. 2, an apparatus according to the present invention is shown mounted to a sucker rod pump 200. In this embodiment, Sensor module 202 is mounted to walking beam 204, and the conditioned sensor signals are carried by signal wires 206 to microcontroller module 208. Actuator signals are carried by actuator wires 210 from microcontroller module 208 to power box 212 for controlling prime mover 214.

Figure 3:
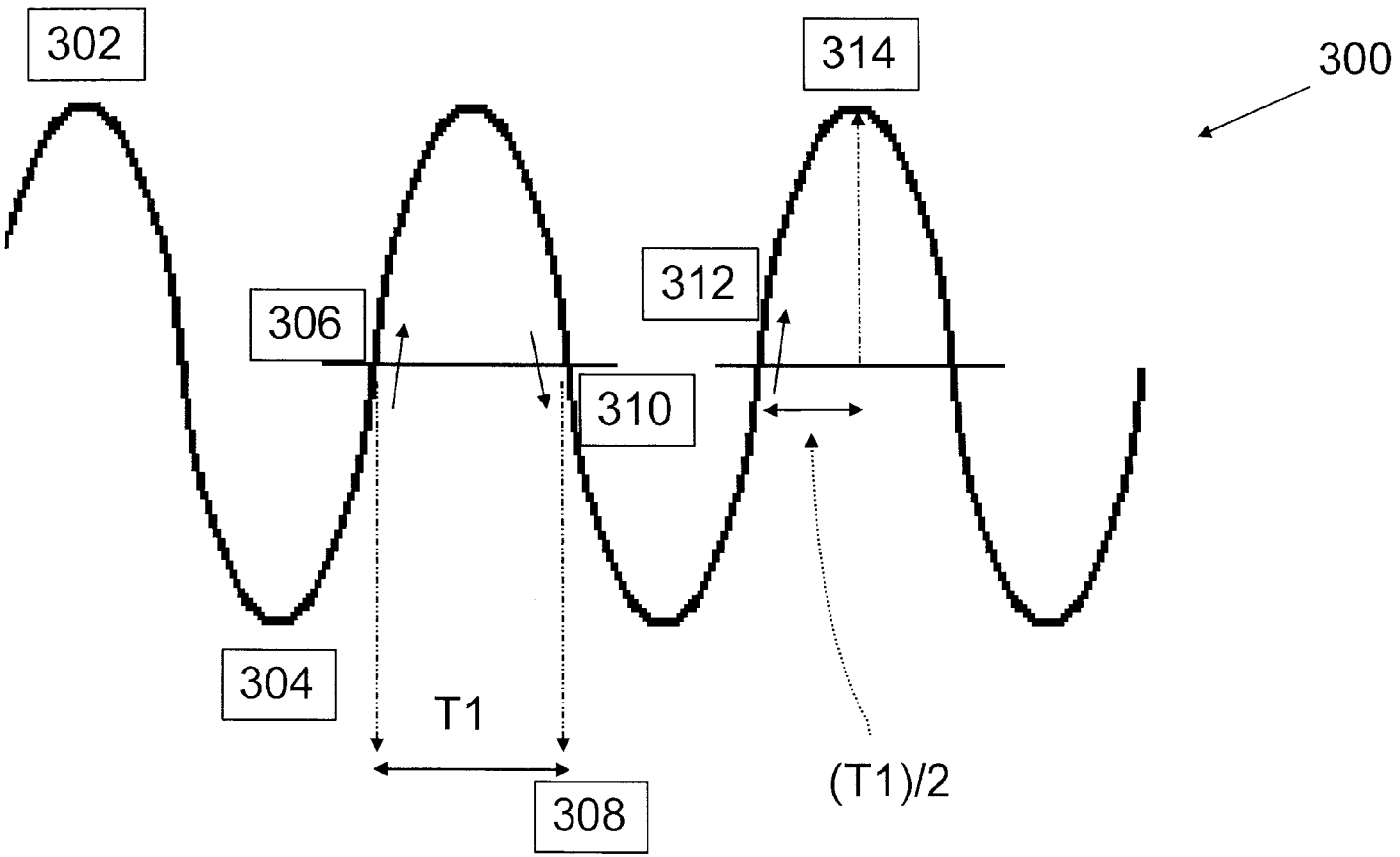
FIG. 3 illustrates a method for compensating for offset and amplitude drift in position sensor data according to an embodiment of the present invention.

The present invention encompasses a method for the operation of the apparatus 100, which can be embodied as software within the non-volatile memory 110 for running the microcontroller 108. Referring now to FIG. 3, a method for compensating for offset and amplitude drift in position data is illustrated 300. The position of the walking beam during the pump cycle describes a sinusoidal curve moving between a maximum and a minimum position, but position sensor data may be noisy due to, for example, vibration of the walking beam because of friction, or because of mechanical instability at the maximum and a minimum positions of the walking beam. In addition, the sensor reading may drift with respect to its amplitude or it's offset due to temperature fluctuations or due to long term changes in the mounting of the sensor module to the walking beam. In order to accurately identify the maximum and minimum points of the walking beam motion without the need for calibration or operator attention, a novel, self-adapting method is used. In the method, consecutive maximum 302 and minimum 304 positions are identified. A position horizon is calculated as the midpoint of the maximum and minimum position values. When the walking beam next crosses the position horizon 306, a timer is started and the time interval 308 to the next horizon crossing 310 in the opposite direction is recorded. The time of the maximum or minimum points (peak time) is calculated as the midpoint between horizon crossings. The process is repeated for each cycle, whereby the horizon 312 and peak times 314 are continuously updated, thereby self-correcting for offset and amplitude and permitting recording of the peak times without calibration or operator intervention.

It will be readily appreciated that the method can be used to determine both maxima and minima in position data.

Figure 4:
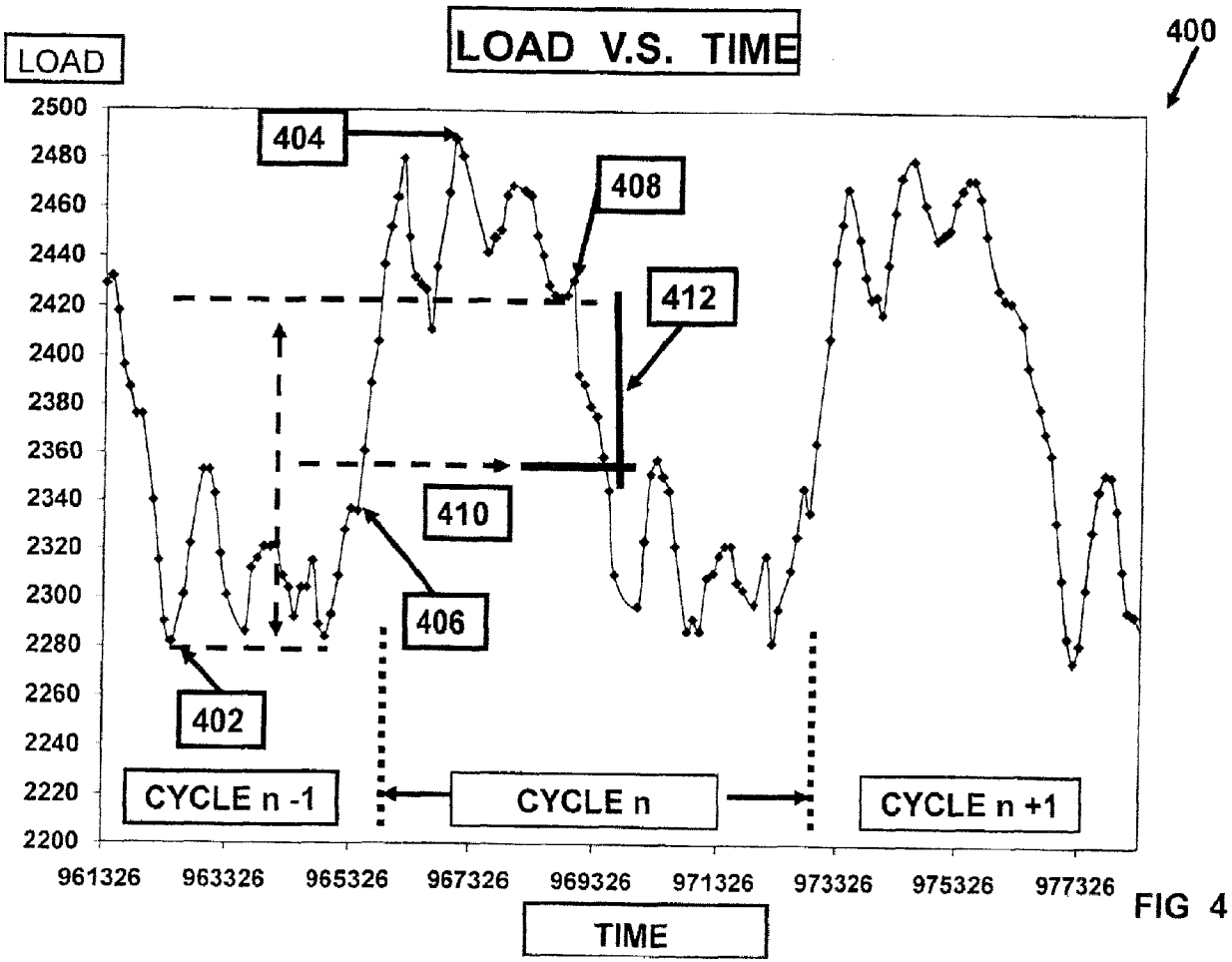
FIG. 4 illustrates a method for identifying a pump off condition in load sensor data according to an embodiment of the present invention.

The present invention further provides a method for identifying a pump off condition in a sucker rod pump, as illustrated in FIG. 4. For each pump cycle, the minimum load 402, the maximum load 404, the start-up load 406 measured at the position minimum time, and the start-down load 408 measured at the position maximum time, are recorded. The start of the next downstroke is then identified, and a reference load boundary 410 is calculated by adding to the minimum load a predetermined fraction of the difference between the minimum and start-down loads. The time for the load to decrease to below the reference load boundary is recorded 412. If the load has not decreased below the reference load boundary within a predetermined time, a pump off condition is indicated. The predetermined fraction used to calculate the reference load boundary is preferably about one-half but it could also be set to one-quarter or up to three-quarters.

Figure 5:
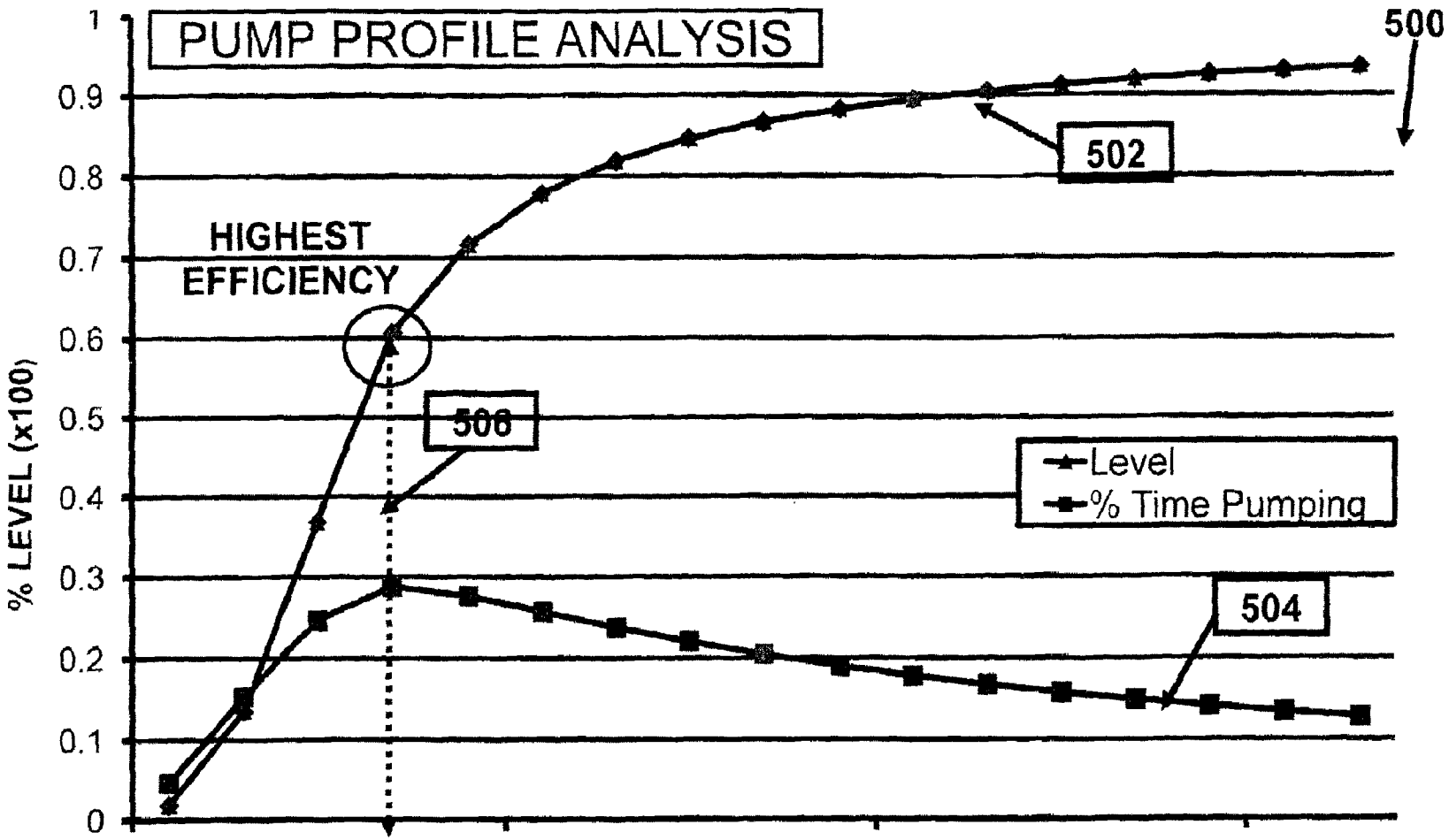
FIG. 5 illustrates a method for optimizing hold down time in the operation of a sucker rod pump according to an embodiment of the present invention.

The present invention further provides a method for optimizing the hold down time for clearing a pump off condition in a sucker rod pump, as illustrated in FIG. 5. The pump off condition indicates that the fluid in the well has been depleted and the capacity of the well to naturally refill is lower than the pump capacity of the well. Thus, a hold down period is required to permit the well to refill. The refill time is determined by geological and electromechanical characteristics of the well. However, it is know that an optimum hold down time provides the most efficient production rate. Referring now to FIG. 5, the hold down time is incrementally increased within predetermined limits and by predetermined step size for each subsequent pump off condition. The pumping span, which is the length of time to the next pump off condition, is recorded. As the hold down time increases, the percentage of time spent pumping increases to a maximum and then decreases 504. The level of fluid achieved in the well after each hold down period is inferred as a percentage from the subsequent pumping span 502. The hold down period providing optimum percentage of time spent pumping is identified by interpolation 506, and the pump is operated with this hold down period for optimum or near-optimal operation.

Figure 6A:
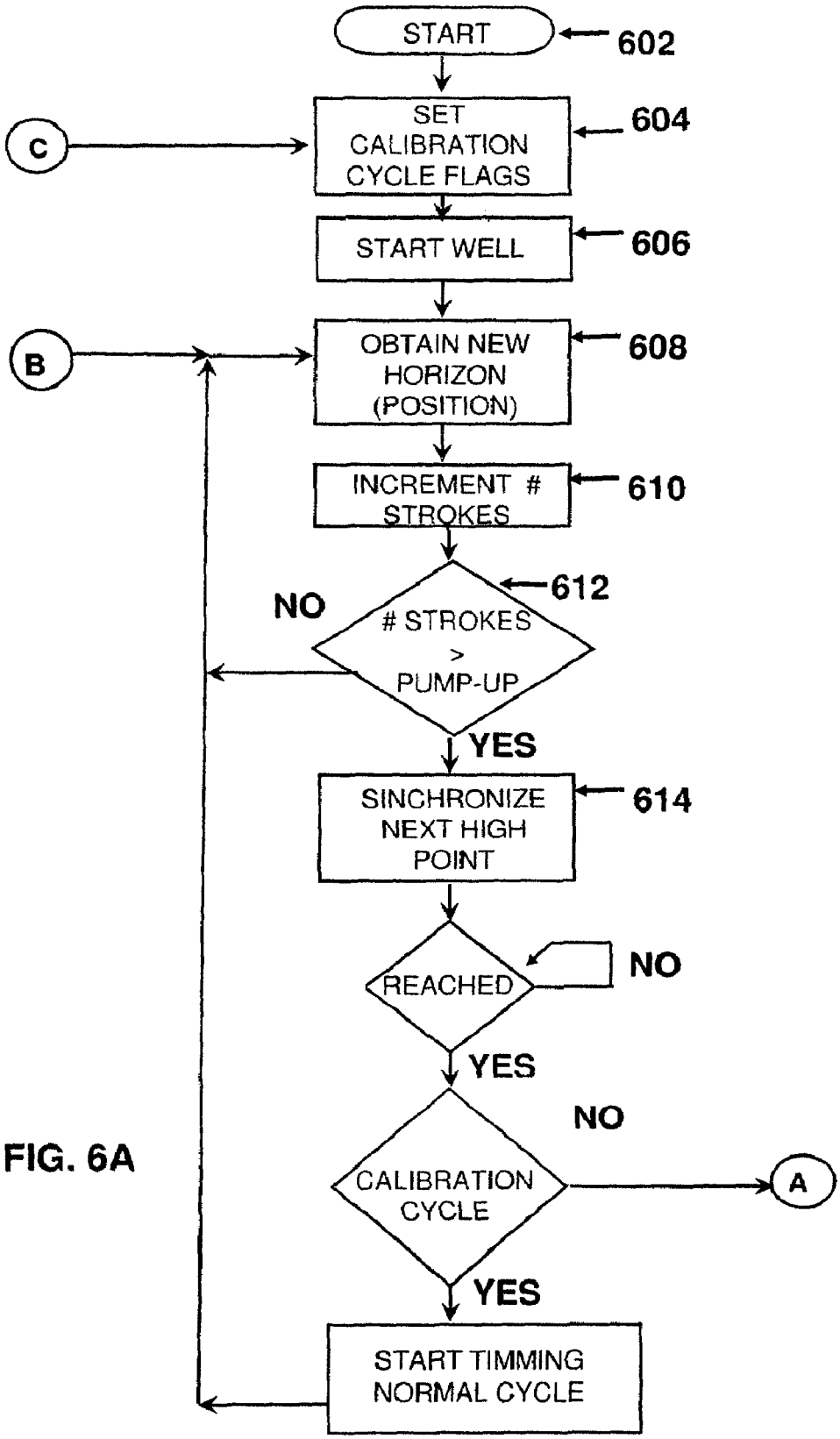
FIG. 6 shows a flow diagram for operation of a system for monitoring and controlling a sucker rod pump according to an embodiment of the present invention.
Figure 6B:
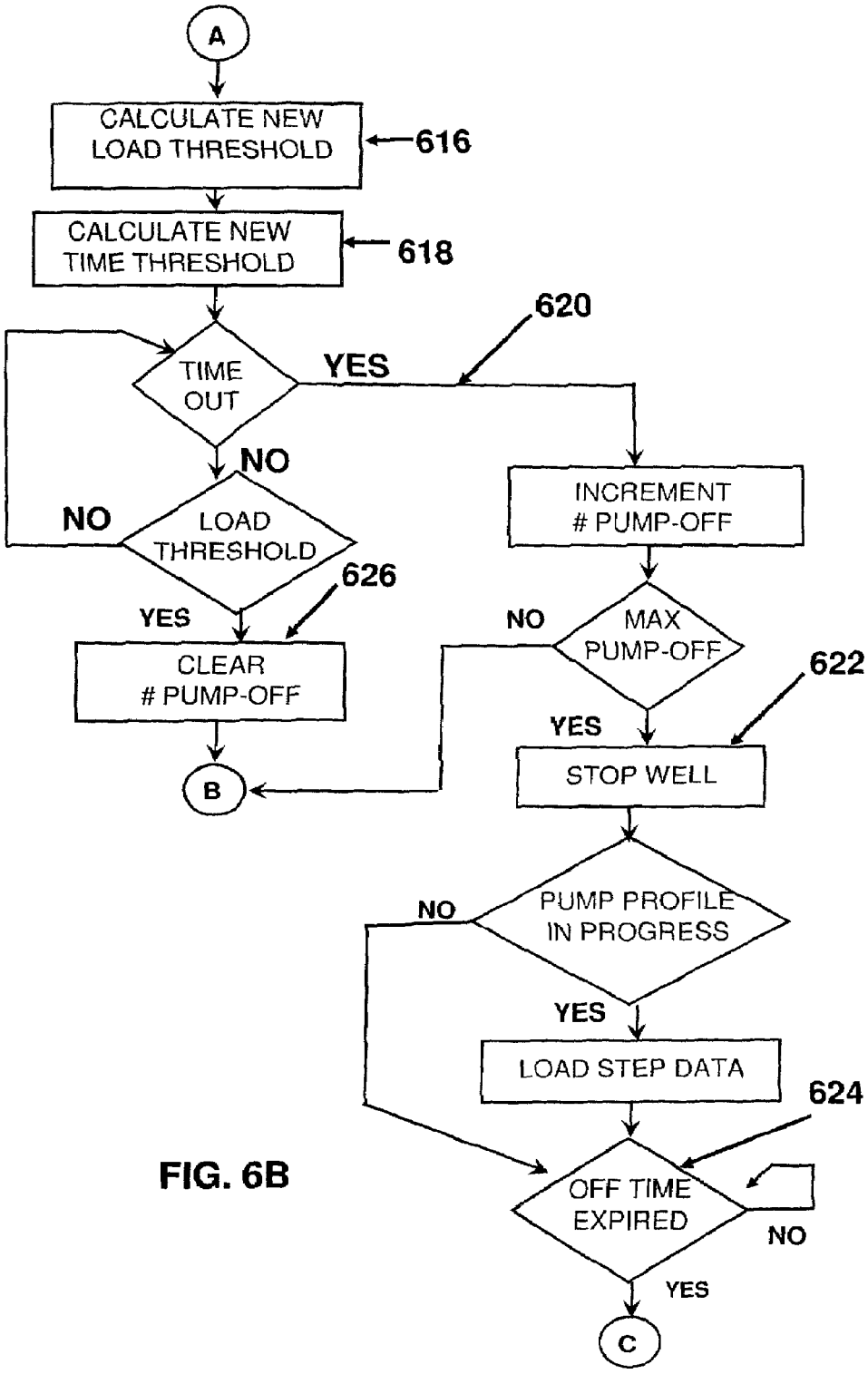

Referring now to FIG. 6, a flowchart for operation of a system according to the present invention, integrating the previous methods, is shown. In use, the apparatus of the system is started 602 and software flags initialized 604. The prime mover of the well is started 606 and the horizon is calculated as previously described 608. Steps 608, 610 and 612 comprise a cycle that operates until a predetermined number of pump-up strokes have been performed for pump conditions to stabilize prior to calibration. The next high point is determined 614, and if not in a calibration cycle at point A a new reference load boundary and a new pump-off time-out are calculated 616, 618 as previously described. If the load fails to drop below the load threshold within the time threshold, a pump off condition is detected 620, the well is stopped for the hold down time 624, and then control is returned to point C. If a pump off condition is not detected 626, control returns to point B for another pump cycle.

The present apparatus and system has a number of advantages and benefits compared to certain devices of the prior art. After the sensor module is mounted to the walking beam, the apparatus of the present invention can operate the pump and calibrate its operation with the minimum of operator intervention, and in particular without the operator having to calibrate the sensors or periodically adjust the operating parameters to account for aging or drift in sensor response. Further, the apparatus, system, and method of the present invention can automatically detect pump off condition and can shut down the pump for a hold down period to permit the pump to refill. Yet further, without user intervention the optimum hold down period can be determined, and the pump efficiently run thereafter. Yet further, the apparatus provides for remote collection of historical and real time data through wireless communication, and for remote programming of the apparatus if desired.

While the invention has been described in connection with its preferred embodiments, it should be recognized that changes and modifications can be made therein without departing from the scope of the appended claims.

What is claimed is:

1. A method of compensating for offset and amplitude drift in position or load sensor data from a sucker rod pump, the method comprising the steps of: (a) providing position sensor data proportional to an inclination of a walking beam of said pump and load sensor data proportional to a well load during operation of said pump; (b) calculating a position horizon value from a midpoint of consecutive minimum and maximum position or load values; (c) measuring a time interval between a positive horizon crossing and a negative horizon crossing; (d) calculating a peak time from a midpoint of said time interval; (e) updating the horizon and peak time values by repeating steps (b) to (d) for every cycle; (f) for each pump cycle recording a minimum load, maximum load, start-up load and start-down load; and (g) calculating a new reference load boundary for a subsequent pump cycle by adding to the minimum load a predetermined fraction of a difference between the start-down load and the minimum load; whereby compensation for offset and amplitude drift in the position and load sensor data is achieved.

2. The method of claim 1, in which the position sensor data is collected through use of an inclinometer and the load sensor data is collected through use of a load cell.

3. A system for self-adapting to amplitude and offset variability in load or position data of a sucker rod pump, the system comprising:

a sucker rod, a prime mover, a walking beam, and a microcontroller module comprising, in electronic communication, a microcontroller, a non-volatile memory, one or more actuators for controlling the prime mover, and at least two ports for receiving sensor data; a sensor module comprising a load sensor and a position sensor, the sensor module capable of mounting to the walking beam, outputs of the load sensor and position sensor connected to the ports of said microcontroller module; said non-volatile memory comprising software for running by said microcontroller for processing said sensor data and operating said actuators; and a wireless module for providing communication between said microcontroller module and a remote wireless device, said software when executed instructing the microcontroller to: (a) collect position sensor data proportional to an inclination of a walking beam of said pump and load sensor data proportional to a well load during operation of said pump; (b) calculate a position horizon value from a midpoint of consecutive minimum and maximum position values; (c) measure a time interval between a positive horizon crossing and a negative horizon crossing; (d) calculate a peak time from a midpoint of said time interval; (e) update the horizon and peak time values by repeating steps (b) to (d) for every cycle; (f) for each pump cycle recording a minimum load, maximum load, start-up load and start-down load; and (g) calculating a new reference load boundary for a subsequent pump cycle by adding to the minimum load a predetermined fraction of a difference between the start-down load and the minimum load; whereby the system self-adapts to offset and amplitude drift in the position and load sensor data.

4. A method for identifying a pump off condition in a sucker rod pump, the method comprising: (a) providing position sensor data proportional to an inclination of a walking beam of said pump and load sensor data proportional to a well load during operation of said pump; (b) for each pump cycle, recording a minimum load, maximum load, start-up load, and start-down load, according to the method of claim 1; (c) identifying a start of a downstroke for a subsequent pump cycle according to the method of claim 1; (d) calculating a reference load boundary by adding to the minimum load a predetermined fraction of a difference between a start-down load and the minimum load; (e) recording a time for a load to decrease below said reference load boundary; and (f) determining that a pump off condition has occurred if the load has not decreased below said reference load boundary within a predetermined time.

5. The method of claim 4, in which the predetermined fraction is about one-half.

6. A system for detecting a pump off condition in a sucker rod pump, the system comprising, a sucker rod, a prime mover, a walking beam, and a microcontroller module comprising, in electronic communication, a microcontroller, a non-volatile memory, one or more actuators for controlling the prime mover, and at least two ports for receiving sensor data; a sensor module comprising a load sensor and a position sensor, the sensor module capable of mounting to the walking beam, outputs of the load sensor and position sensor connected to the ports of said microcontroller module; said non-volatile memory comprising software for running by said microcontroller for processing said sensor data and operating said actuators; and a wireless module for providing communication between said microcontroller module and a remote wireless device, said software when executed instructing the microcontroller to: (a) collect position sensor data proportional to an inclination of a walking beam of said pump and load sensor data proportional to a well load during operation of said pump; (b) for each pump cycle, record a minimum load, maximum load, start-up load, and start-down load, according to the method of claim 1; (c) identify a start of a downstroke for a subsequent pump cycle according to the method of claim 1; (d) calculate a reference load boundary by adding to the minimum load a predetermined fraction of a difference between the start-down load and the minimum load; (e) record a time for a load to decrease below said reference load boundary; and (f) determine that a pump off condition has occurred if the load has not decreased below said reference load boundary within a predetermined time.

* * * * *